US007807037B2

(12) United States Patent
Joslin

(10) Patent No.: US 7,807,037 B2
(45) Date of Patent: Oct. 5, 2010

(54) APPARATUS AND METHOD FOR WHITE LAYER AND RECAST REMOVAL

(75) Inventor: Frederick R. Joslin, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 281 days.

(21) Appl. No.: 12/035,076

(22) Filed: Feb. 21, 2008

(65) Prior Publication Data

US 2008/0179195 A1 Jul. 31, 2008

Related U.S. Application Data

(60) Division of application No. 11/539,290, filed on Oct. 6, 2006, now abandoned, which is a continuation of application No. 10/867,229, filed on Jun. 14, 2004, now abandoned.

(51) Int. Cl.
*B23H 3/04* (2006.01)

(52) U.S. Cl. ..... 205/651; 204/224 M; 205/640

(58) Field of Classification Search ..... 205/640, 205/651; 204/224 M
See application file for complete search history.

(56) References Cited

U.S. PATENT DOCUMENTS

| | | | | |
|---|---|---|---|---|
| 3,202,595 | A | 8/1965 | Inoue | |
| 4,206,028 | A | 6/1980 | Inoue | |
| 4,522,692 | A | 6/1985 | Joslin | |
| 5,320,721 | A | 6/1994 | Peters | |
| 6,251,257 | B1 | 6/2001 | Cochran | |
| 6,837,775 | B2 | 1/2005 | Anand et al. | |
| 7,462,273 | B2 * | 12/2008 | Mielke | 205/651 |
| 2006/0081481 | A1 | 4/2006 | Bayer et al. | |

FOREIGN PATENT DOCUMENTS

| | | |
|---|---|---|
| GB | 815090 | 6/1959 |
| JP | 36-5259 | 5/1936 |
| JP | 40-28038 | 12/1940 |

OTHER PUBLICATIONS

Japanese Office Action for JP 2005-166304, dated May 13, 2008.
European Search Report for EP 05253676.0, dated Sep. 25, 2008.

* cited by examiner

*Primary Examiner*—Harry D. Wilkins, III
*Assistant Examiner*—Nicholas A. Smith
(74) *Attorney, Agent, or Firm*—Bachman & LaPointe, P.C.

(57) ABSTRACT

A method for removing a metal layer comprising the steps of providing a part having a slot, providing a porous metallic cathode comprising a recess bounded by a wall having an outer surface corresponding to the slot, inserting the porous metallic cathode into the slot, introducing an electrolyte into the recess of the porous metallic cathode, and removing a portion of an inner surface of the slot by flowing an electric current between the part and the porous metallic cathode.

20 Claims, 1 Drawing Sheet

APPARATUS AND METHOD FOR WHITE LAYER AND RECAST REMOVAL

CROSS-REFERENCE TO RELATED APPLICATION

This application is a divisional of a prior application Ser. No. 11/539,290, filed Oct. 6, 2006, now abandoned, entitled APPARATUS AND METHOD FOR WHITE LAYER AND RECAST REMOVAL, the disclosure of which is incorporated herein as if set forth at length, which is a continuation-in-part of application Ser. No. 10/867,229, filed Jun. 14, 2004, now abandoned, entitled APPARATUS AND METHOD FOR WHITE LAYER AND RECAST REMOVAL the disclosure of which is incorporated by reference herein as if set forth at length.

TECHNICAL FIELD

The invention relates to an apparatus, and method for using such an apparatus, for removing small amounts of surface metal from a part. More particularly, the invention relates to a method for removing white layer and/or recast debris from metal parts.

BACKGROUND OF THE INVENTION

Machining slots, particularly blade retention slots, using SAM (Super Abrasive Machining) or wire EDM (Electrical Discharge Machining) often times results in the creation of unwanted material upon the machined surface. In particular, SAM tends to produce undesirable, thin (approximately 0.0001 inch) localized areas consisting of white layer and bent grains. Similarly, wire EDM tends to produce an undesirable thin (approximately 0.0001 inch) uniform layer of recast material along the surface cut.

As white layer and recast material is generally unwanted and may have an unacceptable deleterious effect on the operation As white layer and recast material is generally unwanted and may have an unacceptable deleterious effect on the operation of parts such as blade retention slots, it is desirable to precisely and uniformly remove a thin (up to approximately 0.0005 inch) layer so as to remove all of the white layer and/or recast material. Once such white layer and/or recast material is removed, the disk slots may optionally then be conventionally shot peened to provide desirable compressive stresses. Unfortunately, SAM or EDM re-machining would produce the same metallurgical damage as described above.

What is therefore needed is a method for removing small amounts of material from the working surfaces of blade retention slots, so as to precisely and uniformly remove undesirable layers of white layer or recast material. Such method must be able to precisely and uniformly remove a thin layer of approximately 0.0005 inches from the inner surface of a slot.

SUMMARY OF THE INVENTION

Accordingly, it is an object of the present invention to provide an apparatus, and method for using such an apparatus, for removing small amounts of surface metal from a part. More particularly, the invention relates to a method for removing white layer and/or recast debris from metal parts.

In accordance with the present invention, a method for removing a metal layer comprises the steps of providing a part having a surface from which material is to be removed, providing a porous metallic cathode comprising a recess bounded by a wall having an outer surface corresponding to the part surface, inserting the porous metallic cathode onto the part surface, introducing an electrolyte into the recess of the porous metallic cathode, and removing a portion of the part surface by flowing an electric current between the part and the porous metallic cathode.

In further accordance with the present invention, a cathode comprises a wall structured to form a porous electrical cathode having a recess, a first retaining plate attached to a first end of the porous electrical cathode, a second retaining plate attached to a second end of the porous electrical cathode, and a third retaining plate attached between the first end and the second end of the porous electrical cathode, and an electrolyte conduit inserted through the first retaining plate into the recess.

In further accordance with the present invention, a method for removing metal layers comprises the steps of providing a part having a plurality of slots, providing a porous metallic cathode comprising a recess bounded by a wall having an outer surface corresponding to the slot, inserting the porous metallic cathode into one of the plurality of slots, introducing an electrolyte into the recess of the porous metallic cathode, removing a portion of an inner surface of the one of the plurality of slots by flowing an electric current between the part and the porous metallic cathode while introducing the electrolyte, removing the porous metallic cathode from the one of the plurality of slots, moving the part and the cathode relative to one another such that another one of the plurality of slots is aligned with the porous metallic cathode, and repeating the introducing step.

The details of one or more embodiments of the invention are set forth in the accompanying drawings and the description below. Other features, objects, and advantages of the invention will be apparent from the description and drawings, and from the claims.

DETAILED DESCRIPTION

It is therefore a teaching of the present invention to provide an apparatus, and a method for using such an apparatus, to precisely and uniformly remove a thin layer of unwanted material from a surface to be treated, which is exemplified in the present disclosure as the inner surface of a slot, preferably a blade retention slot. This is accomplished by utilizing the part into which there is machined the blade retention slot as an anode. A metallic cathode comprises a porous, corrosion resistant, metallic material such that the outer surface of the metallic cathode is similar in shape to, but smaller than, the inner surface of the slot formed into the metal anode. An electrolyte is then injected into an interior cavity or recess of the porous metallic cathode and permitted to diffuse through the cathode and into the space between the metallic cathode and the metal anode. An electrical current is then produced to flow between the metal anode and the metal cathode at a rate and for a time sufficient to remove a precisely controlled, generally uniform layer from the inner surface of the slot.

Figure 1:
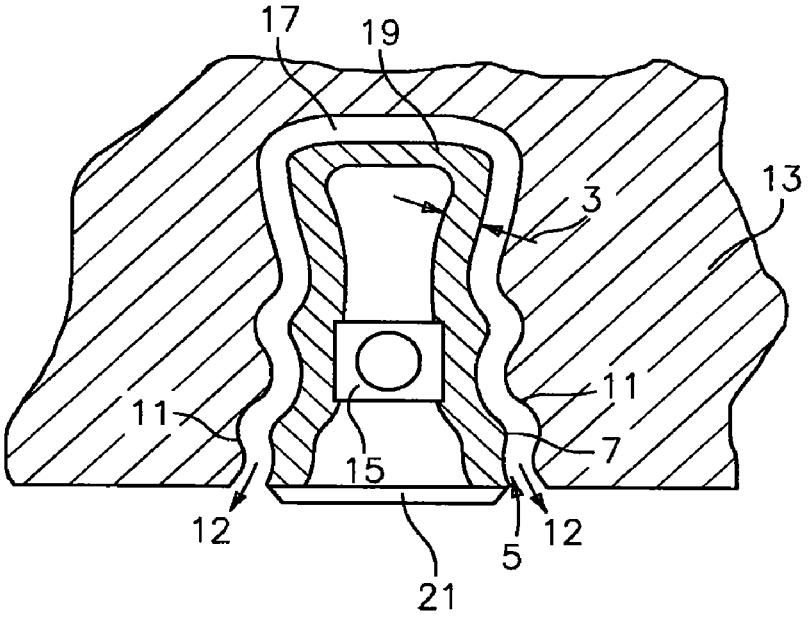
FIG. 1 is an illustration of the metal anode and porous metallic cathode of the present invention.

With reference to FIG. 1, there is illustrated in detail the apparatus of the present invention. Metal anode 13 is illustrated having a gap 17 machined into it from which unwanted material is to be removed. Metal anode 13 may be constructed of any metal. In a preferred embodiment, metal anode 13 is formed of nickel-based alloys, nickel-based superalloys, and titanium alloys. While shown with reference to a blade retention slot, gap 17 is not so limited. Rather, gap 17 may be any recess fabricated into metal anode 13. Gap 17 is formed having an inner surface 11 upon which is located unwanted white layer and/or recast material (not shown) as described above. Typical thicknesses of such unwanted white layer and recast material are of up to approximately 0.0001 inches in thickness.

Porous metallic cathode 5 forms a recess bounded by a wall 19 of a generally uniform wall thickness 3. As constructed, porous metallic cathode 5 possesses an outer surface 7. The shape of outer surface 7 is of a shape similar to that formed by the inner surface 11 of metal anode 13. While the shapes of the inner surface 11 of metal anode 13 and the outer surface 7 of porous metallic cathode 5 are similar, the outer surface 7 of porous metallic cathode 5 is smaller so as to enable porous metallic cathode 5 to fit within the concave recess bounded by the inner surface 11 of metal anode 13. Preferably, the outer surface 7 of porous metallic cathode 5 is between 0.005 and 0.025 inches smaller than the inner surface 11 of metal anode 13. This results in a gap 17 formed between the outer surface 7 of porous metallic cathode 5 and the inner surface 11 of metal anode 13 extending for between approximately 0.005 and 0.025 inches. In a preferred embodiment, gap 17 extends for approximately 0.015 inches between inner surface 11 and outer surface 7.

As noted above, wall 19 is of a substantially uniform wall thickness 3. In operation, an electrolyte is introduced into the concave recess formed by wall 19 and permitted to diffuse through the porous metallic cathode 5 and into gap 17. It is therefore desirable that the electrolyte diffuses at a substantially even rate across the entire outer surface 7 of porous metallic cathode 5. This is achieved by fashioning porous metallic cathode 5 of a wall 19 of substantially uniform wall thickness 3.

In order to permit an electrolyte introduced into an interior cavity of porous metallic cathode 5 to permeate the wall 19 and fill up gap 17, thereby performing a conduit for electric current between porous metallic cathode 5 and metal anode 13, porous metallic cathode 5 must be formed of a material providing pores through which the electrolyte may travel. Porous metallic cathode 5 is therefore formed of a porous, and preferably corrosion resistant metal. More preferably, such a metal is formed of porous stainless steel. Most preferably, the metal used to form porous metallic cathode 5 is approximately 100 micron porous stainless steel. A preferred method of forming porous metallic cathode 5 is to wire EDM a portion of porous stainless steel so as to produce a porous metallic cathode 5 of a desired geometry wherein the outer surface 7 of the porous metallic cathode 5 corresponds to the inner surface 11 of the metal anode 13 as described above.

Figure 2:
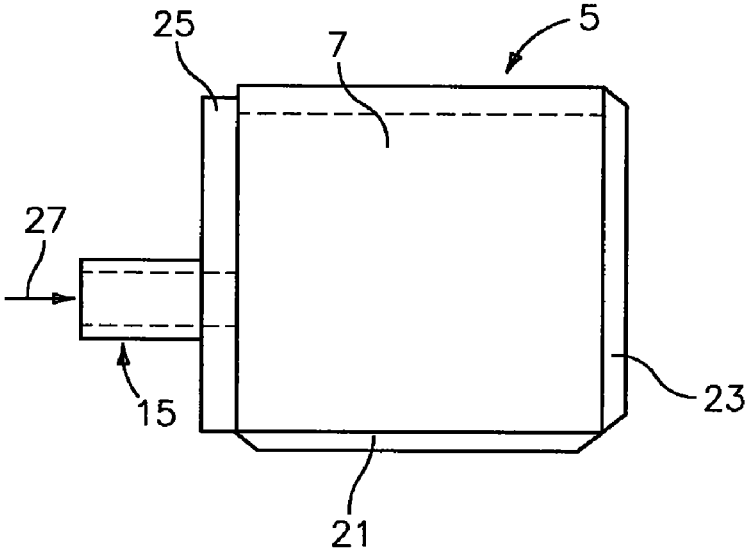
FIG. 2 is a diagram of the apparatus of the present invention showing the retaining plates Like reference numbers and designations in the various drawings indicate like elements.

With reference to FIG. 2, there is illustrated the porous metallic cathode 5 of the present invention shown from the side. Attached to the porous metallic cathode 5 are a plurality of retaining plates 21, 23, 25. Through one such retaining plate 25 is inserted an electrolyte conduit 15 through which electrolyte 27 may be introduced into the interior recess of porous metallic cathode 5. In a preferred embodiment, electrolyte conduit 15 has a cross section, preferably non-circular, facilitating the gripping of electrolyte conduit 15 to avoid unwanted rotation during operation. Retaining plates 23, 25 are of a shape similar to that formed by outer surface 7 of porous metallic cathode 5 and are attached to both the front and rear ends of porous metallic cathode 5. As such, retaining plates 23, 25 serve to insure that electrolyte 27 introduced into an interior recess of porous metallic cathode 5 via electrolytic conduit 15 does not immediately flow out of the front or rear ends of porous metallic cathode 5. Similarly, retaining plate 21 serves to prevent electrolyte 27 introduced into an interior recess of porous metallic cathode 5 via electrolyte conduit 15 from exiting through the bottom of porous metallic cathode 5. As illustrated, electrolyte conduit 15 is attached to retaining plate 25 such that electrolyte 27 introduced into electrolyte conduit 15 may travel into the interior recess of porous metallic cathode 5. In this manner, electrolyte 27 may be introduced into an interior recess of porous metallic cathode 5 via electrolyte conduit 15 at a rate and pressure so as to produce a precisely controllable rate of diffusion of the electrolyte 27 through the wall 19 of porous metallic cathode 5 and into gap 17.

In operation, porous metallic cathode 5 is positioned within gap 17. An electrolyte 27 is then introduced into porous metallic cathode 5 via electrolyte conduit 15. Electrolyte 27 may be either an acid-based or saline-based electrolyte. Electrolyte 27 is introduced via electrolyte conduit 15 at a rate sufficient to entirely fill gap 17 and allow for discharge electrolyte/debris 12 to exit the gap 17. A typical flow rate for electrolyte 27 is between approximately 0.5 and 3 GPMs/inch$^2$. In a preferred embodiment, the flow rate is 1 GPM/inch$^2$.

Once electrolyte 27 is introduced via electrolyte conduit 15, diffuses through the wall 19 of porous metallic cathode 5, and fills up gap 17, an electric current is induced across porous metallic cathode 5 and metal anode 13. The electric current is formed from providing a low voltage differential across porous metallic cathode 5 and metal anode 13. Typical values for this voltage in the case of a part fabricated from a nickel based alloy, range from approximately 5 to 20 volts. In a preferred embodiment, the voltage is approximately 10.5 volts DC. A current sufficient to remove a layer of material of a desired thickness may be applied over a surface area of the inner surface for an amount of time sufficient to achieve the desired removal of material. The amount of current utilized may be dependent upon the surface area and thickness of material being removed from the inner surface of the metal anode. As a result, the current value, and corresponding current density (A/in$^2$), varies as the surface area and amount of material being removed varies. For example, a current of about 45 A may be applied across a surface area of about 8.65 in$^2$ for a current density of about 5.2 A/in$^2$ at a voltage of about 10.5 V for about 108 seconds to remove about 0.001 in. of material from the inner surface 11 of the metal anode 13.

The material removed from the inner surface 11 of metal anode 13 is discharged in the form of a metal hydroxide sludge partially forming discharge electrolyte/debris 12. This debris may be discarded or may be filtered out of discharge electrolyte/debris 12 so as to leave behind relatively pure electrolyte 27 which may be reintroduced via electrolyte conduit 15 and reused.

In another embodiment, the present invention may be employed to efficiently remove white layer and recast material in a plurality of slots. With reference to FIG. 1, metal anode 13 typically comprises a plurality of fir tree shaped slots 17 fabricated, and radially disposed, about a disk or hub each gap 17 separated from its neighbors by a uniform distance. In such an instance, porous metallic cathode 5 is inserted into a gap 17 and an electrolyte is introduced and electric current provided as described above to remove metal from the surface of gap 17. Porous metallic cathode 5 is then removed from gap 17, the disk or hub forming said metal anode and cathode 5 are moved relative to one another, e.g., the disk is rotated or otherwise moved, so as to bring another gap 17 in alignment with porous metallic cathode 5, and the process is repeated.

By varying the voltage across the porous metallic cathode 5 and metal anode 13, the rate of introduction of electrolyte 27, and the duration of time over which the voltage is applied, it is possible to remove a uniform and precisely controlled amount of material from the inner surface 11 of the metal anode 13.

One or more embodiments of the present invention have been described. Nevertheless, it will be understood that various modifications may be made without departing from the spirit and scope of the invention. Accordingly, other embodiments are within the scope of the following claims.

What is claimed is:

1. A method for removing metal layers comprising the steps of:

providing a part having a plurality of slots;

providing a porous metallic cathode comprising a recess bounded by a wall having an outer surface corresponding to said slot;

inserting said porous metallic cathode into one of said plurality of slots;

introducing an electrolyte into said recess of said porous metallic cathode;

removing a portion of an inner surface of said one of said plurality of slots by flowing an electric current between said part and said porous metallic cathode while introducing said electrolyte;

removing said porous metallic cathode from said one of said plurality of slots;

moving said part and said cathode relative to one another such that another one of said plurality of slots is aligned with said porous metallic cathode; and repeating said introducing step.

2. The method of claim 1 wherein said providing said porous metallic cathode comprises providing said porous metallic cathode comprising stainless steel.

3. The method of claim 1 wherein said providing said porous metallic cathode comprises providing said porous metallic cathode comprising 100 micron porous stainless steel.

4. The method of claim 1 wherein said providing said porous metallic cathode comprises the step of cutting said porous metallic cathode via wire EDM.

5. The method of claim 1 wherein said providing said porous metallic cathode comprising providing said porous metallic cathode wherein said wall is of a generally uniform thickness.

6. The method of claim 1 wherein said providing said porous metallic cathode comprising providing said porous metallic cathode wherein said outer surface is between approximately 0.005 to 0.025 inches smaller than an inner surface of said part to form a gap of between approximately 0.005 to 0.025 inches.

7. The method of claim 6 wherein said providing said porous metallic cathode comprising providing said porous metallic cathode wherein said outer surface is approximately 0.015 inches smaller than an inner surface of said part to form a gap of approximately 0.015 inches.

8. The method of claim 1 wherein said providing said porous metallic cathode comprises providing said porous metallic cathode comprising an electrolyte conduit having a non circular cross section.

9. The method of claim 1 wherein said introducing said electrolyte comprises introducing said electrolyte selected from the group consisting of acid based electrolytes and saline based electrolytes.

10. The method of claim 1 wherein said introducing said electrolyte comprises introducing said electrolyte at a rate of between 0.5 to 3.0 GPM/in$^2$.

11. The method of claim 10 wherein said introducing said electrolyte comprises introducing said electrolyte at a rate of approximately 1 GPM/in$^2$.

12. The method of claim 1 wherein said flowing said electric current comprises flowing said electric current at a current density of approximately 0.20 amperes/in$^2$.

13. The method of claim 1 wherein said removing said portion comprises introducing said electrolyte at a rate and flowing said electric current at a rate and for a duration sufficient to remove between 0.0005 and 0.0015 inches of said inner surface.

14. The method of claim 13 wherein said removing said portion comprises introducing said electrolyte at a rate and flowing said electric current at a rate and for a duration sufficient to remove approximately 0.001 inches of said inner surface.

15. The method of claim 1 wherein said providing said porous metallic cathode comprises providing said porous metallic cathode having a porosity sufficient to produce an electrolyte flow rate of between 0.5 and 3.0 GPM/in$^2$.

16. The method of claim 1 wherein said slots are blade retention slots in a disk.

17. The method of claim 16 wherein the removed metal layers comprise recast.

18. The method of claim 16 wherein the slots are formed by machining or wire EDM.

19. The method of claim 17 wherein the slots are formed by machining or wire EDM.

20. The method of claim 1 wherein the slots are formed by machining or wire EDM.

* * * * *